United States Patent [19]

Sugiyama et al.

[11] 4,129,928

[45] Dec. 19, 1978

[54] SLIDE FASTENER

[75] Inventors: Takayuki Sugiyama, Kurobe; Kihei Takahashi, Uozu, both of Japan

[73] Assignee: Yoshida Kogyo K. K., Tokyo, Japan

[21] Appl. No.: 775,976

[22] Filed: Mar. 9, 1977

[30] Foreign Application Priority Data

Mar. 17, 1976 [JP] Japan ..... 51/32103[U]

[51] Int. Cl.[2] ..... A44B 19/26; A44B 19/36

[52] U.S. Cl. ..... 24/205.11 R; 24/205.15 R

[58] Field of Search ..... 24/205.11 R, 205.11 F, 24/205.15 R

[56] References Cited

U.S. PATENT DOCUMENTS

| | | | |
|---|---|---|---|
| 2,228,422 | 1/1941 | Thompson | 24/205.11 R |
| 2,441,007 | 5/1948 | Carlile | 24/205.11 F |
| 2,577,855 | 12/1951 | Moehler | 24/205.11 R |
| 2,887,749 | 5/1959 | Morin | 24/205.11 R |
| 3,170,207 | 2/1965 | Morin | 24/205.11 R |
| 3,522,327 | 9/1950 | Winterhalter | 24/205.11 R |
| 3,618,178 | 11/1971 | Hansen | 24/205.11 F |
| 3,959,858 | 6/1976 | Kaisha | 24/205.11 R |

*Primary Examiner*—Bernard A. Gelak

*Attorney, Agent, or Firm*—Bucknam and Archer

[57] ABSTRACT

A slide fastener includes a bottom end stop member for limiting the downward or opening movement of a slider along a pair of series of fastener elements carried on and along confronting longitudinal edges of oppositely disposed stringer tapes. Each of upper and lower wings of the slider has a pair of guide flanges extending on and along its lateral edges. The lengths of each pair of guide flanges are so related to the pitch of the fastener elements that those two opposed fastener elements, located within a guide channel of the slider in adjacent relationship to the front ends of the two pairs of guide flanges, have their respective longitudinal axes disposed downwardly of the front ends of the lateral guide flanges when the slider is in its lowermost position.

3 Claims, 3 Drawing Figures

SLIDE FASTENER

BACKGROUND OF THE INVENTION

1. Field of the Invention

This invention relates to a slide fastener of the discrete type in which a series of uniformly spaced fastener elements are mounted astride an inner beaded edge of each of oppositely disposed stringer tapes.

2. Prior Art

With reference to FIG. 3, a slide fastener 10' of this general type comprises a slider 14' having a pair of upper and lower wings (not shown) interconnected by a neck (not shown) located at its front end to define, together with a pair of guide flanges 18' formed along lateral edges of each of the upper and lower wings, a generally Y-shaped guide channel 22' through the slider for guiding the movement of the fastener elements 13' therethrough. The lengths of each pair of guide flanges 18' and the pitch of the fastener elements 13' have not been taken into consideration so that at least either of those two opposed fastener elements 13'*c*, located within the Y-shaped guide channel 22' in adjacent relation to the front end of the slider 14', are necessarily positioned with respect to the front ends 34' of the corresponding guide flanges 18' in the manner shown in FIG. 3 when the slider 14' is in its lowermost position. More specifically, the fastener element 13'*c* has its longitudinal axis A' disposed upwardly of the front ends 34' of the guide flanges 18'. When a lateral pull (indicated by arrow F') tending to separate the opposed stringer tapes away from each other is exerted on the slide fastener, the fastener element 13'*c* is pivoted or angularly moved in a counterclockwise direction about inner edges 36' of the front ends 34' of the guide flanges 18' which make contact with an end face 25' of the fastener element 13'*c* and serve as an axis of rotation. Thus, the end face 25' and the inner edges 36' function as the lever and fulcrum. Since the distance between the front side face 26' of the fastener element 13'*c* and the inner edges 36' is greater than the distance between the inner edges 36' and the rear side face 27', an inwardly directed force (indicated by arrow f'1) exerted on the outer rear corner 37' of the fastener element is substantially greater than an outwardly directed force (indicated by arrow f'2) exerted on the outer front corner 38' of the fastener element 13'*c*. The result is that even when the lateral pull F' is not so severe, the fastener element can easily be turned or angularly moved in a counterclockwise direction about the inner edges 36' representing the fulcrum to forcibly disengage the fastener element 13'*c* from the beaded tape edge 12'.

SUMMARY OF THE INVENTION

It is therefore an object of this invention to provide a slide fastener of the discrete type in which when a slider is in its lowermost position, the slider, a bottom end stop and fastener elements cooperate to prevent those two opposed fastener elements, located within a Y-shaped slider guide channel in adjacent relation to the front end of the slider, from being forcibly disengaged from respective beaded tape edges even when a relatively severe lateral pull tending to separate the opposed stringer tapes away from each other is exerted on the slide fastener.

Briefly stated, an end stop member has a base portion against which the rear end of a slider abuts in its lowermost position to restrict the downward movement of the slider. The end stop member has a plug portion which extends from the base portion in a direction away from the bottom ends of the associated stringer tapes. The plug portion is snugly receivable in the rear end portion of a Y-shaped guide channel of the slider for preventing the slider from tilting relatively to the end stop member when the slider is in its lowermost position. Each of upper and lower wings of the slider has a pair of guide flanges extending on and along its lateral edges. The lengths of each pair of guide flanges are so related to the pitch of the fastener elements and to the longitudinal offset spacing as between fastener elements that interengage, that those two opposed fastener elements, located within the Y-shaped guide channel in adjacent relation to the front ends of the two pairs of guide flanges, have their respective longitudinal or central axes disposed downwardly of the front ends of the lateral guide flanges when the slider is in its lowermost position.

Many other advantages and features of the present invention will become manifest to those versed in the art upon making reference to the detailed description and the accompanying sheet of drawings in which a preferred structural embodiment incorporating the principles of the present invention is shown by way of example.

DESCRIPTION OF THE PREFERRED EMBODIMENT

Figure 1:
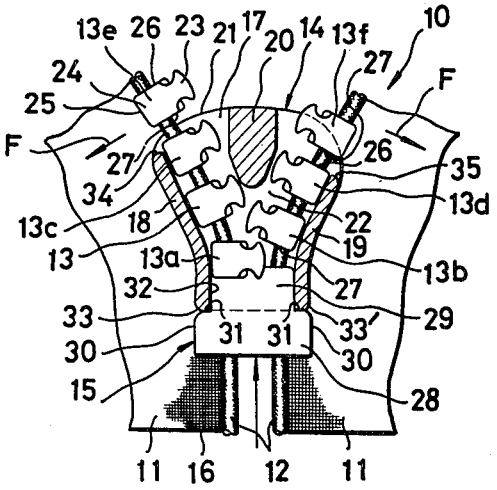
FIG. 1 is a fragmentary plan view of a slide fastener provided in accordance with the present invention, showing a slider engaging a bottom end stop member in its lowermost position.

FIG. 1 partially shows a slide fastener 10 including a pair of oppositely disposed stringer tapes 11,11 carrying on and along their respective confronting beaded edges 12,12 a pair of series of uniformly spaced fastener elements 13 which are taken into and out of mutual engagement by a slider 14 movable along the fastener elements 13 to close and open the slide fastener 10. The slide fastener 10 also includes a bottom end stop member 15 fixedly secured to and holding the opposed marginal portions of the strigner tapes 11,11 in parallel, inseparable relation adjacent to the bottom end 16 of the slide fastener 10.

The slider 14 includes a body having a pair of spaced apart upper and lower wings 17,17 each having a pair of upwardly diverging guide flanges 18,19 extending on and along its lateral margins. The upper and lower wings 17,17 are interconnected by a neck 20 located at the front end 21 of the slider 14 to define together with the two pairs of guide flanges 18,19 a generally Y-shaped guide channel 22 through the slider 14 for guiding the movement of the fastener elements 13 therethrough.

Each of the fastener elements 13 includes a body of generally rectangular configuration having a coupling head portion 23 and a base portion 24 extending from the head portion 23 and peripherally embracing the beaded tape edge 12, the base portion 24 being of generally square configuraiton and having a flat end face 25 and a pair of flat front and rear side faces 26,27.

The end stop member 15 includes a body having a base portion 28 of square cross-section and a plug portion 29 of square cross-section extending from the base portion 28 in a direction away from the bottom end 16 of the slide fastener 10. The plug portion 29 has a smaller dimension in the transverse direction of the slide fastener 10 than the base portion 28 so that the opposite side faces 30,30 of the end stop member 15 are stepped at regions at which the base and plug portions 28,29 are joined together, to define a pair of shoulders 31,31 which are capable of serving as abutment surfaces as will hereinafter more fully be described. The plug portion 29 is so sized and shaped as to be snugly received in a throat or rear end portion 32 of the slider guide channel 22 when the slider 14 is in its lowermost position.

The end stop member 15 as well as the fastener elements 13 is made of a synthetic resin and injection-moulded on the inner marginal portions of the opposed stringer tapes 11,11. The lowermost fastener element **13*a* is integrally united with the plug portion 29. With this arrangement, the lowermost fastener element 13*a* is positively held in position with respect to the beaded tape edge 12, and serves to block the flow of molten synthetic resin escaping from the mould by which the end stop member 15 is formed. The rear side face 27 of the penultimate fastener element 13*b*** also serves to prevent the flow of such escaped molten synthetic resin.

The slider 14 engages the bottom end stop member 15 in its lowermost position, with the plug portion 29 snugly received in the throat portion 32 and with the rear ends 33,33' of each pair of the guide flanges 18,19 held respectively in abutting engagement with the shoulders 31,31, as shown in FIG. 1, so that the slider 14 is held against movement and tilting action relatively to the end stop member 15. The length of each of the guide flanges 18 is so related to the pitch of the fastener elements 13 that that fastener element **13*c*, located within the guide channel 22 in adjacent relation to the front ends 34,34 of the flanges 18,18 has its longitudinal axis A disposed downwardly of the front ends 34 of the guide flanges 18. Similarly, the length of each of the guide flanges 19 is so related to the pitch of the fastener elements 13 that that fastener element 13*d*, located within the guide channel 22 in adjacent relation to the front ends 35,35 of the flanges 19,19, has its longitudinal axis disposed downwardly of the front ends 35 of the guide flanges 19. Although the front ends 34,35 of the guide flanges 18,19 are shown in the drawings to lie generally flush respectively with the front side faces 26,26 of the fastener elements 13*c*,13*d*, the front ends 34,35 can be located between the rear side faces 27,27 of the adjacent fastener elements 13*e*,13*f* and their longitudinal axes A,A, respectively, so long as the front ends 34,35 do not interfere with the adjacent fastener elements 13*e*,13*f*. Further, although the guide flange 18 is made longer than the guide flange 19 and hence has its front end 34 extended beyond the front end 35 of the guide flange 19 in the longitudinal direction of the slide fastener 10**, they may have the same length so long as they meet the above-mentioned requirements.

Since the slider 14 is held against movement and tilting action relatively to the end stop member 15 in its lowermost position as previously mentioned, the relative positions of the fastener elements **13*c*,13*d* and the guide flanges 18,19 are maintained as described in the preceding paragraph even when oppositely directed lateral forces tending to separate the stringer tapes 11,11 away from each other are exerted on the slide fastener 10**, the lateral forces being indicated by arrows F,F.

Figure 2:
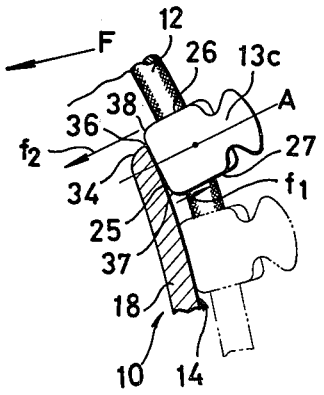
FIG. 2 is an enlarged, fragmentary view of the slide fastener, showing the relative positions of the slider and those fastener elements received in a guide channel of the slider.
Figure 3:
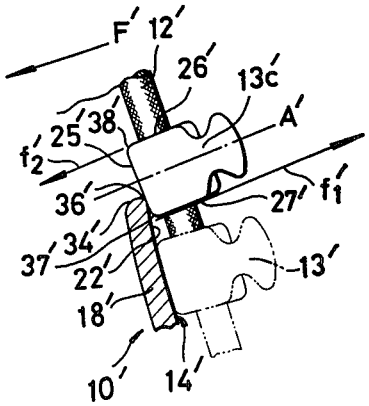
FIG. 3 is a view similar to FIG. 2 but showing a slide fastener provided in accordance with the prior art.

As best shown in FIG. 2, upon application of the lateral forces F,F to the stringer tapes 11,11, the end face 25 of the fastener element **13*c* makes contact with the inner edges 36,36 of the front ends 34,34 of the guide flanges 18,18. The end face 25 and the inner edges 36,36 function as the lever and fulcrum as earlier mentioned with reference to the prior art, but since the distance between the front side face 26 of the fastener element 13*c* and the inner edges 36,36 is smaller than the distance between the inner edges 36,36 and the rear side face 27, an inwardly directed force (indicated by arrow $f_1$) exerted on the outer rear corner 37 of the fastener element 13*c* is substantially less in magnitude than an outwardly directed force (indicated by arrow $f_2$) exerted on the outer front corner 38. Therefore, except when the lateral forces F,F are excessively severe, the fastener element 13*c* will not be pivoted or angularly moved in a counterclockwise direction about the inner edges 36,36 representing the fulcrum to thereby prevent the forcible disengagement of the fastener element 13*c* from the beaded tape edge 12. Similarly, the fastener element 13*d* is prevented from angular movement about the inner edges 35,35** in a clockwise direction.

Although various minor modifications may be suggested by those versed in the art, it should be understood that we wish to embody within the scope of the patent warranted hereon, all such embodiments as reasonably and properly come within the scope of our contribution to the art.

What is claimed is:

1. In a slide fastener comprising a pair of oppositely disposed stringer tapes carrying on and along their confronting longitudinal edges a pair of series of uniformly spaced interengageable fastener elements, a slider movable upwardly and downwardly along said fastener elements for respectively coupling and uncoupling the same, and a bottom end stop member interconnecting said stringer tapes adjacent to the bottom ends thereof, said slider including a body having a pair of spaced apart upper and lower wings each having a pair of guide flanges on and along the lateral edges thereof, said guide flanges extending between respective upward front ends and downward rear ends, said upper and lower wings being interconnected by a neck located at the front end of said slider to define together with said guide flanges a generally Y-shaped guide channel therethrough for guiding the movement of said fastener elements therethrough, and each of said fastener elements including a body of generally rectangular configuration having a pair of upward front and downward rear side faces and an outer end face, the improvement which comprises said end end stop members having a base portion against which the rear end of said slider abuts in its lowermost position to restrict the downward movement of said slider, said end stop member having a plug portion which extends from said base portion in a direction away from the bottom ends of said stringer tapes, and said plug portion being snugly receivable in the rear end portion of said Y-shaped guide channel for preventing said slider from tilting relative to said end stop member when said slider is in its lowermost position, and said slider having guide flanges of respective lengths so related to the pitch of said fastener elements and to the longitudinal offset spacing as between fastener elements that interengage, that when the slider is in its lowermost position, those two opposed fastener elements that are the uppermost fastener elements located within the guide channel, have their respective central axes located downwardly of the front ends of said guide flanges to reduce pivotal reaction forces on said uppermost fastener elements when oppositely directed lateral forces are applied to said stringer tapes; one of each pair of guide flanges having its front end extended beyond that of the other in the longitudinal direction of said slide fastener.

2. A slide fastener according to claim 1, in which said base portion is of generally square cross-section and in which said plug portion has a generally square cross-section and a smaller dimension in the transverse direction of said slide fastener than said base portion so that the opposite side faces of said end stop body are stepped at regions at which said base and plug portions are joined together, to define a pair of abutment shoulders with which the rear ends of each pair of guide flanges are engageable when said slider is in its lowermost position.

3. A slide fastener according to claim 1, in which said two opposed fastener elements have their front side faces lying substantially flush with the front ends of said lateral guide flanges, respectively.

* * * * *